US009144922B2

(12) United States Patent
Roth et al.

(10) Patent No.: US 9,144,922 B2
(45) Date of Patent: Sep. 29, 2015

(54) SHANK-TYPE PICK

(71) Applicants: Betek GmbH & Co. KG, Aichhalden (DE); Wirtgen GmbH, Windhagen (DE)

(72) Inventors: Markus Roth, Aichhalden (DE); Thomas Allgaier, Schramberg-Sulgen (DE); Thomas Lehnert, Oberraden (DE)

(73) Assignee: Wirtgen GmbH (DE)

( * ) Notice: Subject to any disclaimer, the term of this patent is extended or adjusted under 35 U.S.C. 154(b) by 0 days.

(21) Appl. No.: 14/347,410

(22) PCT Filed: Oct. 11, 2012

(86) PCT No.: PCT/EP2012/070147
§ 371 (c)(1),
(2) Date: Mar. 26, 2014

(87) PCT Pub. No.: WO2013/053814
PCT Pub. Date: Apr. 18, 2013

(65) Prior Publication Data

US 2014/0232172 A1 Aug. 21, 2014

(30) Foreign Application Priority Data

Oct. 11, 2011 (DE) ..... 10 2011 054 393

(51) Int. Cl.
*E21C 35/18* (2006.01)
*B28D 1/18* (2006.01)
*E21C 35/197* (2006.01)

(52) U.S. Cl.
CPC ..... *B28D 1/186* (2013.01); *E21C 35/18* (2013.01); *E21C 35/197* (2013.01)

(58) Field of Classification Search
CPC ..... E21C 35/197
See application file for complete search history.

(56) References Cited

U.S. PATENT DOCUMENTS 3,830,546 A * 8/1974 Kniff ..... 299/107
4,149,753 A 4/1979 Stoltz et al.
4,327,947 A 5/1982 Bower, Jr.

(Continued)

FOREIGN PATENT DOCUMENTS

CN 201474694 U 5/2010
DE 1923922 11/1970

(Continued)

OTHER PUBLICATIONS

Translation of DE 102005001535B3.*

(Continued)

*Primary Examiner* — John Kreck
(74) *Attorney, Agent, or Firm* — Lucian Wayne Beavers; Patterson Intellectual Property Law, PC

(57) ABSTRACT

The invention relates to a shank bit for a road milling machine or the like, having a bit head and a bit shank, the bit shank comprising a first cylindrical segment that is indirectly or directly adjacent to the bit head, and the bit shank comprising a second cylindrical segment that, facing away from the bit head, is indirectly or directly adjacent to the first cylindrical segment, and the diameter of the second cylindrical segment differing from the diameter of the first cylindrical segment. In a shank bit of this kind, improved utilization properties result from the fact that the first cylindrical segment has a diameter in the range between 18 mm and 30 mm, and an extent in the direction of the longitudinal center axis of the bit shank less than 30 mm.

20 Claims, 7 Drawing Sheets

(56) References Cited

U.S. PATENT DOCUMENTS

| | | | | |
|---|---|---|---|---|
| 4,488,759 | A | 12/1984 | Bergqvist | |
| 4,575,156 | A | 3/1986 | Hunter et al. | |
| 4,632,463 | A | 12/1986 | Sterwerf, Jr. | |
| 4,678,238 | A * | 7/1987 | Emmerich | 299/81.1 |
| 5,730,502 | A | 3/1998 | Montgomery, Jr. | |
| 6,113,195 | A | 9/2000 | Mercier et al. | |
| 6,851,758 | B2 * | 2/2005 | Beach | 299/107 |
| 8,573,706 | B2 | 11/2013 | Parrott et al. | |
| 2004/0118615 | A1 | 6/2004 | Beach | |
| 2005/0146198 | A1 * | 7/2005 | Hill et al. | 299/76 |
| 2006/0125308 | A1 | 6/2006 | Sollami | |
| 2008/0030065 | A1 | 2/2008 | Frear | |
| 2010/0148568 | A1 | 6/2010 | Latham | |
| 2010/0244545 | A1 | 9/2010 | Hall et al. | |
| 2011/0175430 | A1 | 7/2011 | Heiderich et al. | |
| 2011/0193399 | A1 * | 8/2011 | Monyak et al. | 299/104 |

FOREIGN PATENT DOCUMENTS

| | | | |
|---|---|---|---|
| DE | 2630276 | A1 | 1/1978 |
| DE | 3307895 | A1 | 9/1983 |
| DE | 9411438 | U1 | 11/1994 |
| DE | 19630642 | A1 | 2/1998 |
| DE | 10325253 | A1 | 12/2004 |
| DE | 102005001535 | B3 | 8/2006 |
| DE | 102009027732 | A1 | 1/2011 |
| EP | 0412287 | A2 | 2/1991 |
| FR | 2522578 | A1 | 9/1983 |
| WO | 2009003561 | A1 | 1/2009 |
| WO | 2013053813 | A2 | 4/2013 |

OTHER PUBLICATIONS

International Search Report in corresponding International Application No. PCT/EP2012/070144, dated Feb. 6, 2014, 3 pp.

International Search Report in corresponding International Application No. PCT/EP2012/070146, dated Feb. 6, 2014, 3 pp.

International Search Report in corresponding International Application No. PCT/EP2012/070147, dated Feb. 6, 2014, 3 pp.

U.S. Appl. No. 14/347,405, filed Oct. 11, 2012 to Allgaier et al.

U.S. Appl. No. 14/347,409, filed Oct. 11, 2012 to Roth et al.

Office Action in co-pending U.S. Appl. No. 14/347,405 dated Apr. 7, 2015, 17 pp.

* cited by examiner

SHANK-TYPE PICK

The invention relates to a shank bit for a road milling machine or the like, having a bit head and a bit shank, the bit shank comprising a first cylindrical segment that is indirectly or directly adjacent to the bit head, and the bit shank comprising a second cylindrical segment that, facing away from the bit head, is indirectly or directly adjacent to the first cylindrical segment, and the diameter of the second cylindrical segment differing from the diameter of the first cylindrical segment.

Shank bits of this kind are known, for example, from DE 33 07 895 A1. Here the bit shank is embodied as a stepped shank, two cylindrical segments of different diameters being provided. The first cylindrical segment is directly adjacent to the bit head, and has a larger diameter than the second cylindrical segment. The second cylindrical segment forms, facing away from the bit head, the long-side end of the bit shank. Incorporated in the region of the second cylindrical segment is a circumferential groove that carries a securing ring. The bit shank can be clamped with the securing ring in a stepped bore of a bit holder. The shank bit is thereby held in lossproof fashion in the axial direction, but freely rotatably in the circumferential direction. The shank bit rotates around its longitudinal center axis during operational use. In that context it abrades with its first cylindrical segment against an associated inner surface of a receiving bore, the latter becoming continuously widened. After a certain utilization period the bit holder is worn out in the region of the receiving bore, and must be replaced.

A similar arrangement is known from DE 26 30 276 C2.

In order to avoid the problem of rapid bit holder wear, a transition has been made to using shank bits having pulled-on clamping sleeves, as shown in WO 2009/003561 A1. Here the bit shank comprises a receptacle region that carries a cylindrical clamping sleeve. The clamping sleeve comprises holding elements that engage into a circumferential groove of the bit shank. This creates a rotary bearing system in which the bit shank rotates within the cylindrical clamping sleeve. Contact between the shank bit and the receiving bore of the bit holder is thereby avoided, so that a longer service life for the bit holder can be achieved. Also provided is a wear protection disk that provides bracing of the bit head with respect to the bit holder in the region between the bit head and the clamping sleeve. The result is that here as well, wear between the shank bit and the bit holder is minimized. An additional parts outlay is necessary for the clamping sleeve and the wear protection disk.

It is an object of the invention to create a shank bit of the kind recited initially that is notable for improved wear properties.

This object is achieved in that the first cylindrical segment of the bit shank has a diameter in the range between 18 mm and 30 mm, and an extent in the direction of the longitudinal center axis of the bit shank less than or equal to 30 mm.

It has been found that with a bit configuration of this kind, on the one hand tilt-stable retention of the bit shank in a receiving bore of a bit holder can be achieved, wear between the bit shank and the receiving bore of the bit holder at the same time being minimized. Stable shank guidance results in particular when the bit shank is retained at its long-side end in the receiving bore with a securing element. During working engagement, forces act obliquely to the longitudinal center axis of the shank bit. This results in bearing stress in the contact region between the first cylindrical segment and the receiving bore. With the dimensioning according to the present invention of the first cylindrical segment, this bearing stress is optimized in such a way that the prevailing surface pressures can reliably be transferred and at the same time minimal frictional wear occurs. The configuration according to the present invention of the bit shank is also suitable in particular for use in connection with a hard-material sleeve, for example a hard-metal sleeve, that forms the receiving bore in the bit holder.

In order to obtain on the one hand sufficiently stable bracing of the shank bit and on the other hand an effectively operating rotary bearing system, according to a preferred variant of the invention provision can be made that the first cylindrical segment has an extent in the direction of the longitudinal center axis of the bit shank in the range between greater than 4 mm and 15 mm.

According to a preferred embodiment of the invention, provision can be made that the second cylindrical segment has a diameter in the range between 14 mm and 25 mm. This cylindrical region is then designed in material-optimized fashion and can reliably dissipate the loads that occur. The diameter discontinuity with respect to the first cylindrical segment is then moreover designed so that excessive notch stresses do not occur.

Particularly preferably, the second cylindrical segment has an extent in the direction of the longitudinal center axis of the bit shank in the range between 10 mm and 40 mm. This makes possible on the one hand sufficiently tilt-stable retention of the bit shank, and on the other hand a low overall height for the shank bit. For utilization of the shank bit in road construction in order to remove concrete or asphalt road surfaces, a longitudinal extent of the second cylindrical segment in the range between 16.5 mm and 26.5 mm is particularly suitable.

A further strength-optimized design of the bit shank is achieved when provision is made that the diameter ratio between the diameter of the first cylindrical segment and the diameter of the second cylindrical segment is in the range between 1.1 and 2.5.

A shank bit according to the invention can be characterized in that the bit head comprises a support segment having an annular circumferential support surface; and that the outside diameter of the support surface is in the range between 30 mm and 60 mm. With a configuration of this kind, the bit head can be stably braced in planar fashion on an abutting surface of the bit holder. This dimensioning of the support surface, in conjunction with the dimensioning according to the present invention of the first and the second cylindrical segment, ensures a load-optimized tool design; in particular in the context of all applicable tasks in the road-milling sector, the load forces are introduced into the bit holder principally via the support surface, and transverse loading of the bit shank within the receiving bore is minimized. A material-optimized design of the shank bit can be achieved with an outside diameter of the support surface in the range between 35 mm and 45 mm. This dimension then allows a sufficiently slender shape for the bit head, which does not present too much frictional resistance to the milled material being removed.

It is also particularly advantageous in this context if provision is made that the ratio of the outside diameter of the support surface to the diameter of the first cylindrical segment is in the range between 1.6 and 3.3; and/or that the ratio of the outside diameter of the support surface to the diameter of the second cylindrical segment is in the range between 2 and 4.2. Material-optimized designs in the interest of the lowest possible notch stress in the region of the step discontinuities are thereby possible. In addition, the shank bits can also be fabricated with short cycle times as mass-produced parts using the cold extrusion process.

In order to allow simple retention of the shank bit to be achieved, according to a variant of the invention provision is made that the bit shank carries at its end facing away from the bit head, in a securing receptacle, a slotted clampable securing element. The securing element can become compressed radially inward upon insertion of the shank bit, with the result that it generates a spreading force in the receiving bore. This also, in particular, makes possible simple assembly.

Provision can furthermore be made in this context that the securing element has an outside diameter in its relaxed state; and that the difference between that outside diameter and the diameter of the second cylindrical segment is in the range between ≥0.05 and/or ≤10 mm. A sufficiently large clamping force is generated in this context; for reasons of material economization, the securing element can have a short extent in the axial direction of the shank bit. With diameter differences ≥0.05 mm a minimum clamping force can be achieved that is just sufficient for low-load tasks. Diameter differences that are oriented more toward the ≤10 mm range generate large clamping forces for demanding loads, for example in surface mining.

The securing element preferably has an annular conformation that forms a partially cylindrical bearing receptacle. This bearing receptacle interacts with a cylindrical circumferential surface of the bit shank in order to form a bearing. To allow simple assembly of the securing element to be achieved, provision can be made that the introduction opening is demarcated by two rims; and that the rims of the bearing receptacle transition, facing apart, into angled introduction chamfers. The securing element can be threaded onto the bit shank by means of the introduction chamfers; it then expands radially in the region of the introduction chamfer and then snaps onto the bit shank.

One conceivable variant of the invention is such that the securing element comprises a clamping part that is equipped radially externally with at least one recess. The recess forms a cross-sectional weakening of the clamping part and reduces the clamping force of the clamping part, so that the clamping force is established in targeted fashion for the application. The recesses furthermore create radially external edges on the securing element, which edges can then clamp in claw fashion against the inner wall of the receiving bore of the bit holder. Secure fastening of the shank bit is thereby achieved in a simple manner.

It is also conceivable for the securing element to comprise a clamping part that is equipped with a fastening segment; and for the cross-section of the clamping part in the direction of the longitudinal center axis to be decreased by means of the fastening segment; or for the clamping part to be bent at its radial outer region. This once again makes possible a reduction in the clamping force of the securing element. In addition, an introduction chamfer that facilitates installation in austere construction site conditions can be formed with the radially external bend. Upon insertion of the shank bit, the bent region arrives at a countersurface of the bit holder in the region of the receiving bore. Because of the bend, the securing ring becomes deflected radially inward and can be slid into the corresponding bore region.

It is particularly advantageous if provision is made that the recesses are sunk radially deeper into the clamping part than the fastening segment extends in that radial direction. The recesses then separate individual retention regions that are formed by the fastening segment, and also reduce the clamping force of the securing element in the region adjacent to the fastening segment.

Particularly preferably, the securing element comprises convex curved segments on its outer periphery. These form abutting regions that ensure reliable retention even when, for example, the receiving bore is partially worn.

In order to allow sufficiently stable retention of the bit shank to be achieved, the shank bit according to the present invention should be such that the securing receptacle is arranged spaced away in the range from 15 mm and 50 mm from the support surface of the bit head.

The securing element preferably comprises two mutually parallel demarcating surfaces that are arranged spaced away from one another in the direction of the longitudinal center axis of the bit shank. The securing element can then be positioned in a circumferential groove of the bit shank as a bearing element, the rotary bearing system then being constituted between the securing element and the bit shank.

The securing element should have, in the securing receptacle, an axial clearance in the direction of the longitudinal center axis of the bit shank of ≤4 mm, particularly preferably ≤2 mm. This then prevents the bit head from lifting off excessively from the bit holder. Axial clearances greater than 4 mm can result in skewing of the shank bit in the receiving bore of the bit holder. Above an axial clearance of preferably ≤2 mm, an effective pump effect is achieved, with which any removed material that may have penetrated between the bit holder and bit shank can be discharged. Particularly preferably, however, the axial clearance selected is ≤1 mm, so as not to induce excessively strong pulses in the bit during operational use, so that the forces on the securing element are thereby kept low.

The radial clearance of the securing element in the relaxed state in the securing receptacle, in the direction perpendicular to the longitudinal center axis of the bit shank, should be in the range between 3 mm and 9 mm. The securing element can then be compressed sufficiently to be able to compensate even for possible dimensional fluctuations in terms of the inside diameter of the receiving bore.

The invention will be explained below in further detail with reference to an exemplifying embodiment depicted in the drawings, in which.

Figure 1:
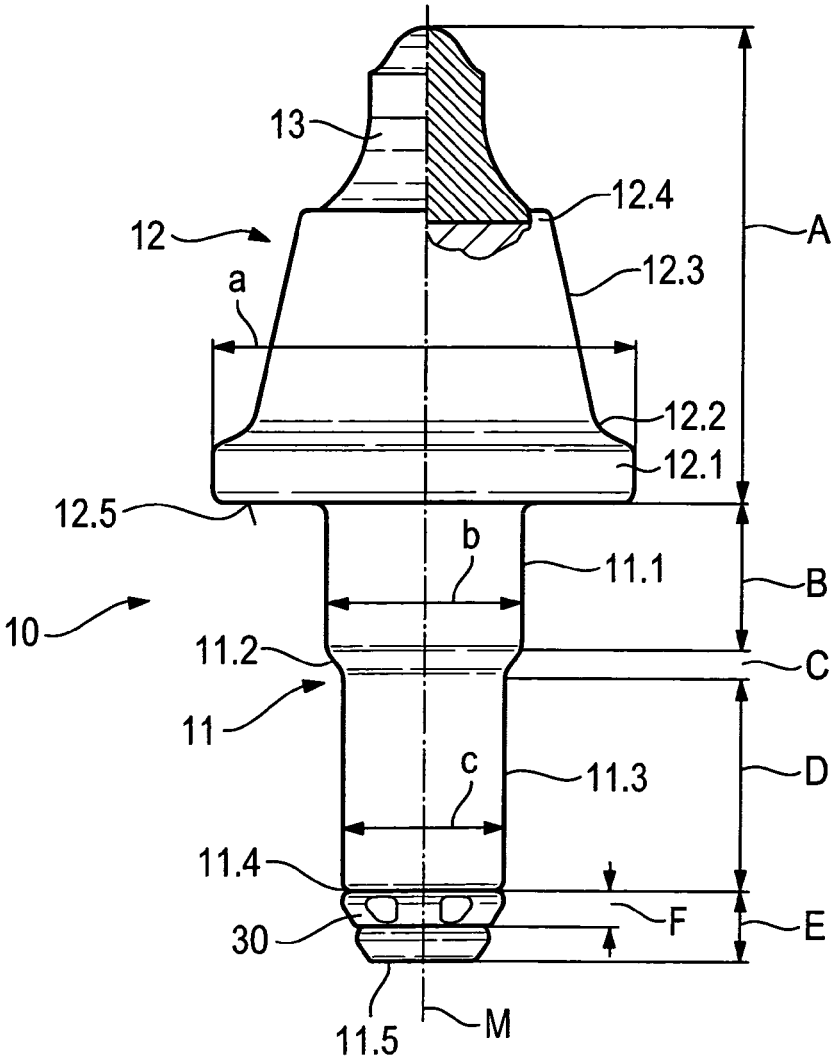
FIG. 1 is a side view and partial section of a shank bit.

FIG. 1 shows a shank bit 10 having a bit shank 11 and a bit head 12 shaped thereon. Bit shank 11 is embodied as a stepped shank, and comprises a first cylindrical segment 11.1 that leads via a frustoconical transitional segment 11.2 into a second cylindrical segment 11.3. A securing receptacle 11.4 in the form of a circumferential groove is provided in the region of second cylindrical segment 11.3. This securing receptacle 11.4 is demarcated at the end by a shoulder 11.5. First cylindrical segment 11.1 is directly adjacent, via a radius transition or alternatively via a frustoconical transitional segment, to a support surface 12.5 of bit head 12. When a frustoconical transitional segment is used, a stress-optimized contour having a conical angle of 45° and an extent in the direction of longitudinal center axis M of bit shank 11 of less than 4 mm has proven advantageous. Support surface 12.5 is embodied annularly, and is constituted by a shoulder-shaped support segment 12.1. Bit head 12, proceeding from support segment 12.1, leads via a taper 12.2 having a concave geometry into a discharge surface 12.3. Discharge surface 12.3 is embodied frustoconically in the present case, but can also be, for example, of cylindrical or concave configuration. At its end facing away from bit shank 11, bit head 12 carries a cutting element 13 in a cutting element receptacle 12.4. Cutting element 13 is made of a hard material, for example of hard metal, and is soldered into cutting element receptacle 12.4.

The component extents of shank bit 10 in the direction of longitudinal center axis M of shank bit 10 are noted in FIG. 1. Specifically, bit head 12, including cutting element 13, has a head length A that is in the range between 35 mm and 60 mm. First cylindrical segment 11.1 has an extent B in the direction of longitudinal center axis M of the bit shank ≤30 mm. An extent of 15 mm is selected in the present case. The length of the transitional segment is labeled C, and should be <10 mm. An extent of approx. 3 mm is selected in the present case. The length of second cylindrical segment 11.3 is noted as D, and has an extent in the direction of longitudinal center axis M in the range between 10 and 40 mm. The length of terminal segment E, encompassing securing receptacle 11.4 and shoulder 11.5, should be a minimum of 3 mm. A dimension of 7 mm is selected in the present case, the groove width F of securing receptacle 11.4 being approx. 3 mm.

Dimensions are further provided in FIG. 1 for outside diameter a of support surface 12.5, diameter b of first cylindrical segment 11.1, and diameter c of second cylindrical segment 11.3. Diameter b of first cylindrical segments 11.1 is in the range between 18 mm and 30 mm. Diameter c of second cylindrical segment 11.3 is selected in the range between 14 mm and 25 mm. Outside diameter a of support surface 12.5 is in the present case between 30 mm and 46 mm, and is selected particularly preferably in the range between 40 mm and 44 mm.

Figure 3:
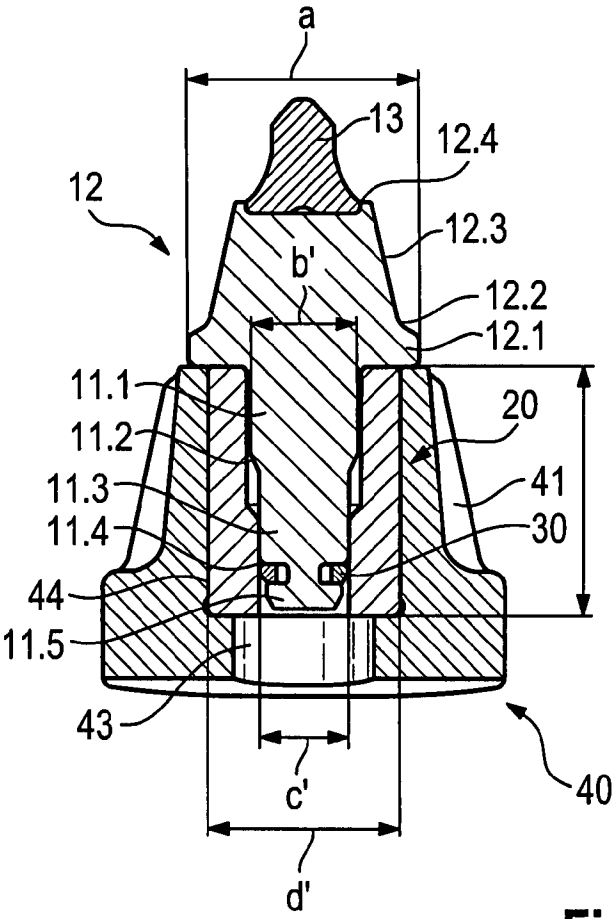
FIG. 3 is a vertical section showing a detail of the depiction of FIG. 2.
Figure 2:
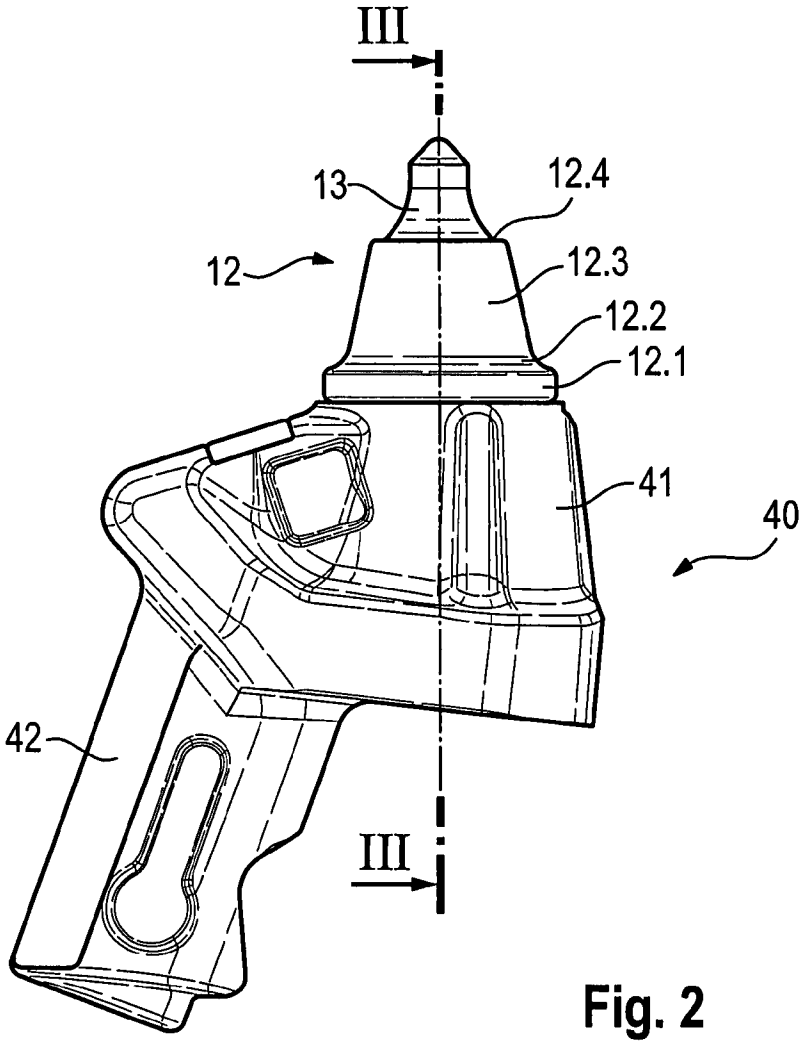
FIG. 2 is a side view showing a combination made up of a bit holder and the shank bit shown in FIG. 1.

FIG. 2 shows a bit holder 40 that is utilized to receive shank bit 10 according to FIG. 1. Bit holder 40 comprises a base part onto which a projection 41 and an insertion projection 42 are integrally shaped. As FIG. 3 shows, projection 41 is equipped with a cylindrical inner receptacle 44 into which an insert 20 made of hard material, in particular of hard metal, is inserted. Insert 40 is embodied in the form of a sleeve, and has a cylindrical outer geometry that is adapted to inside diameter d' of inner receptacle 44 in such a way that upon installation of insert 20 into bit holder 40, a press fit results (interference fit). The inserting motion of insert 20 into inner receptacle 44 is limited by a setback. The setback is embodied in the transitional region of inner receptacle 44 to a drive-out opening 43 embodied as a bore. Inner receptacle 44 and drive-out opening 43 are coaxial with one another. Insert 20 has a stepped bore that comprises a first diameter region 21 and a second diameter region 23. The two diameter regions 21, 23 are guided into one another via a taper 22. Taper 22 has a frustoconical geometry. As is evident from FIG. 3, inside diameter c' of the second diameter region is selected to be smaller than the inside diameter of drive-out opening 43. This results in a drive-out shoulder on insert 20. Insert 20 can thus be ejected as necessary from bit holder 40 by means of a tool introduced through drive-out opening 43 and set against the drive-out shoulder.

Figure 11:
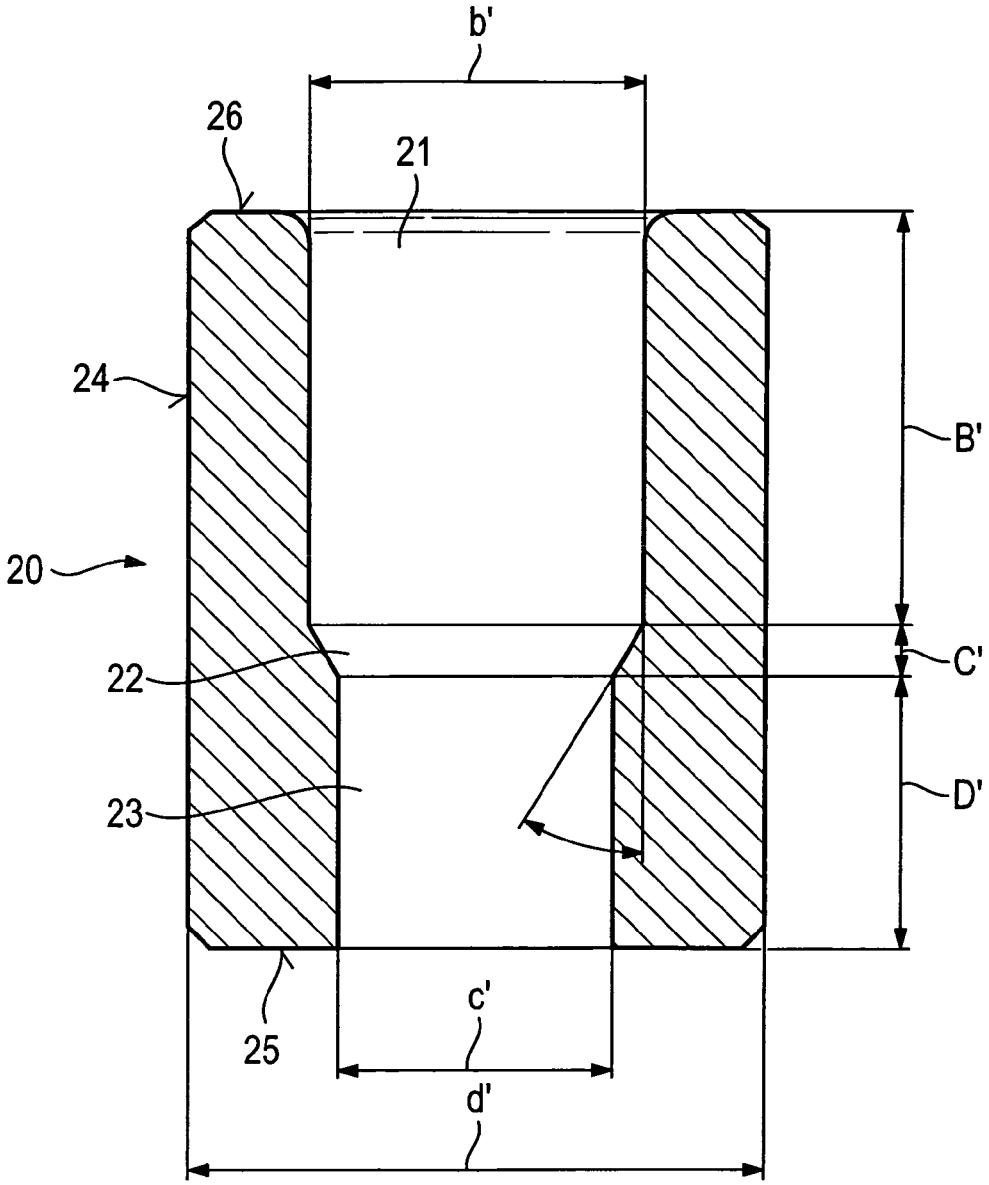
FIG. 11 is a side view and vertical section showing an insert for installation in the bit holder according to FIGS. 2 and 3.

The configuration of insert 20 is detailed further in FIG. 11. As this drawing shows, the external geometry of insert 20 is constituted by a fit surface 24 that, as described above, forms a snug fit with inner receptacle 44. Transversely to the longitudinal center axis of insert 20, insert 20 possesses a lower abutment surface 25 that, in the installed state, comes to a stop against a countersurface of inner receptacle 44, as shown in FIG. 3. An exact association of insert 20 with bit holder 40 is thereby enabled. Insert 20, facing away from abutment surface 25, abuts with an abutting surface 26 flush against an adjoining end face of bit holder 40, as likewise illustrated in FIG. 3. First diameter region 21 of insert 20 has a diameter b', and second diameter region 23 has a diameter c'. Diameters b' and c' are designed in a manner adapted to diameters b and c of the respective first and second cylindrical segments 11.1 and 11.3 of bit shank 22. The association of shank bit 10 with insert 20 is ensured here, with little clearance, in such a way that shank bit 10 remains freely rotatable around its longitudinal central axis M. The extent of first diameter region 21 in the direction of longitudinal central axis M is B'; as FIG. 3 clearly indicates, this extent B' is greater than the extent b of first cylindrical segment 11.1.

The extent of second diameter region 23 is labeled D' in FIG. 11, and the extent of taper region is labeled C'. Extent D' is selected so that bit shank 11 is received entirely within insert 20, as is apparent from FIG. 3.

Figure 4:
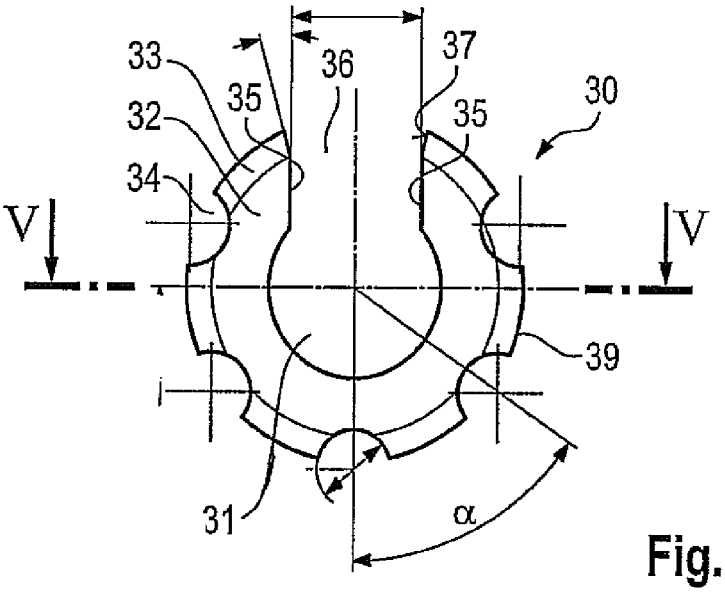
FIG. 4 is a plan view of a securing element.

As mentioned earlier, a securing receptacle 11.4 in the form of a circumferential groove is provided in the region of bit shank 11. A securing element 30 is received in this groove, as shown in further detail in FIGS. 4 to 6. As these drawings show, securing element 30 possesses a partially annular circumferential clamping part 32, radially externally adjacent to which are fastening segments 33, which in the present case are embodied in the form of a chamfer as cross-sectional reductions. The cross-sectional reductions are interrupted by recesses 34 which extend into clamping part 32. The result is to form prong-shaped radially external holding segments 39 in the form of curved regions spaced apart from one another at an angle $\alpha$ preferably from 50° to 70°, in the present case 60°. These convex curved regions serve to clamp securing element 30 in place in second diameter region 23 of insert 20, as shown in FIG. 3. Clamping part 32 surrounds a bearing receptacle 31 that, together with the groove base of securing receptacle 11.4, forms a rotary bearing system. This bearing receptacle 31 opens into a slot that forms an introduction opening 36. Introduction opening 36 is demarcated by two rims 35 that open out into introduction chamfers 37. Introduction chamfers 37 are arranged so that they widen into introduction opening 36.

Figure 5:
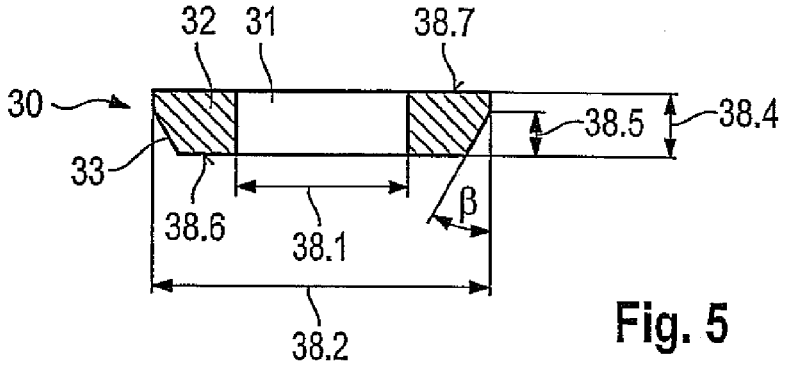
FIG. 5 is a side view, and a section V-V according to FIG. 4, showing the securing element according to FIG. 4.
Figure 6:
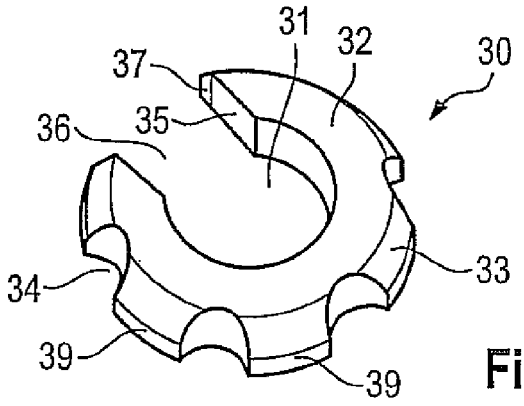
FIG. 6 is a perspective depiction of the securing element according to FIGS. 4 and 5.
Figure 7:
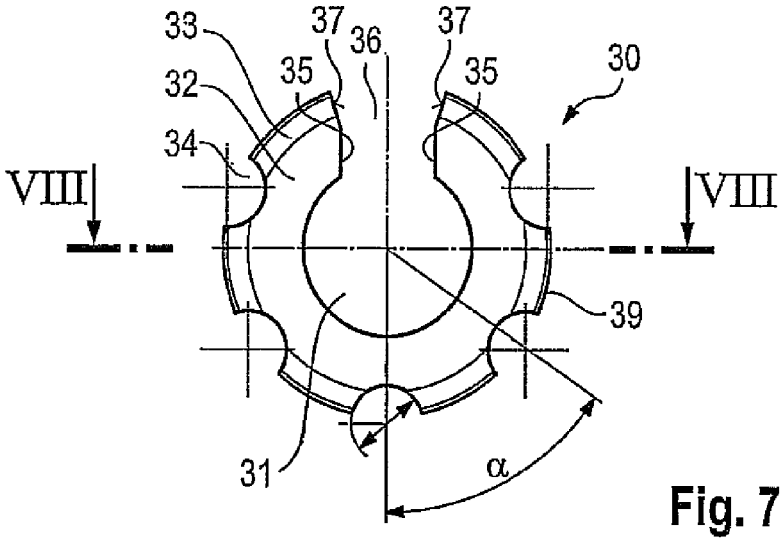
FIG. 7 is a plan view showing a further variant embodiment of a securing element.

As is evident from FIG. 5, bearing receptacle 31 has an inside diameter 38.1, and fastening segments 33 define an outside diameter 38.2. Securing element 30 has an overall height 38.4 that is less than the width of the groove-shaped securing receptacle 11.4. Fastening segments 33 extend over a segment height 38.5, and define an inclination angle $\beta$.

FIGS. 7 to 10 show a further variant configuration of a securing element 30. In these Figures, identical reference characters refer to corresponding elements already described with reference to FIGS. 4 to 6, and reference may be made to the previous statement in order to avoid repetition. Securing element 30 again comprises a bearing receptacle 31 that is radially accessible via an introduction opening 36. Introduction opening 36 is demarcated by a rim 35, and rim 35 leads into introduction chamfers 37. In contrast to the embodiment according to FIGS. 4 to 6, securing element 30 is produced in the form of a stamped and bent part in which no material-removing machining or similar reshaping work is necessary in order to constitute fastening segment 33 that is angled with respect to clamping part 32. Correspondingly, for production of securing element 30, firstly a disk-shaped cross section is stamped out, and that is then reshaped, in a bending step, into the configuration visible in FIG. 8.

Figure 8:
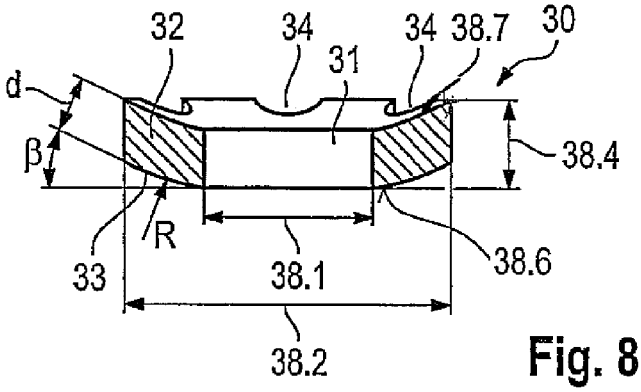
FIG. 8 shows the securing element according to FIG. 7 along the section marked VIII-VIII in FIG. 7.
Figure 9:
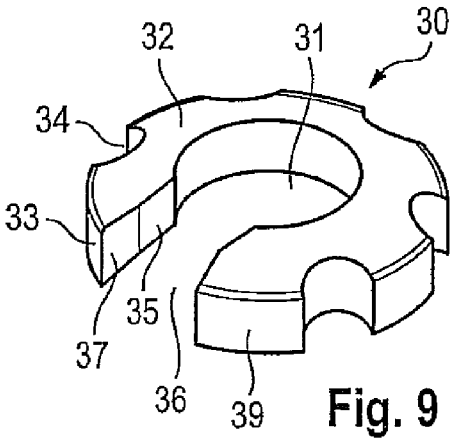
FIGS. 9 and 10 are perspective views of the securing element according to FIGS. 7 and 8.
Figure 10:
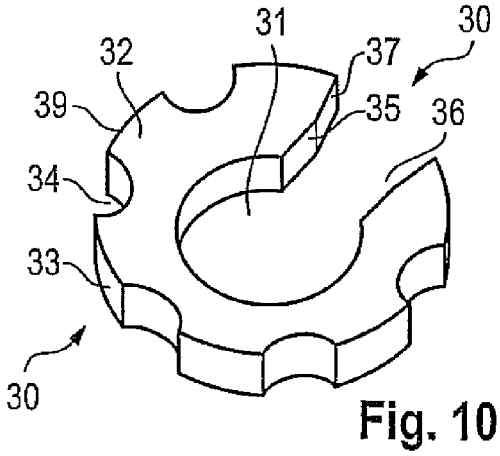

As is evident from FIG. 8, outside diameter 38.2 of securing element 30 is arranged concentrically with the wall (inside diameter 38.1) forming bearing receptacle 31. To achieve this concentricity, either the outer contour of securing element 30 can be reworked, or the stamping die can already be configured so that concentricity is achieved after the concluding bending step.

It is further evident from FIG. 8 that thickness d of securing element 30 is selected to be approximately the same both in the region of clamping part 32 and in the region of fastening segment 33. Fastening segment 33 forms on its underside a convex bulge having a radius R, thus resulting in a surface inclined with respect to the longitudinal center axis of securing element 30, which surface facilitates installation of securing element 30 in insert 20 of bit holder 40, as will be explained in further detail below.

Securing element 30 is concavely indented in the region of its upper side. This results in the formation of linear or narrow strip-shaped abutting regions 38.7 that serve for better rotational behavior of securing element 30 with respect to shank bit 10, as will be explained in further detail below. Recesses 34 are once again recessed in partially circular fashion into fastening segment 33, and extend into the region of clamping part 32.

For installation of securing element 30 on shank bit 10, the latter is firstly placed with introduction chamfers 37 on the groove base of securing receptacle 11.4. Bit shank 11 can then be slid into bearing receptacle 31 by means of a radial pressure, the rotary bearing system then being formed between the groove base of securing receptacle 11.4 and bearing receptacle 31. Securing element 30 expands radially upon insertion of bit shank 11, and once bit shank 11 has passed rims 35, securing element 30 snaps back into its original shape so that bit shank 11 latches into bearing receptacle 31. A lossproof connection of securing element 30 to shank bit 10 is thereby achieved. The unit made up of shank bit 10 and securing element 30 can then be slid into insert 20 of bit holder 40. For this, fastening segments 33 that face toward the free end of bit shank 11 are set onto taper 22. Because of the inclined embodiment of fastening segments 33, as shank bit 10 is slid in, securing element 30 becomes compressed radially inward and can thus be slid into second diameter region 23. Securing element 30 is thereby clamped against the inner wall of second diameter region 23. The deformation of securing element 30 is such that the free rotatability of bit shank 11 is maintained. Securing element 30 reliably braces with its holding segments 39 in second diameter region 23 in the region of fastening segments 33. The insertion motion of shank bit 10 into insert 20 is limited by support surface 12.5 of bit head 12. The latter comes to a stop against abutting surface 26 of insert 20, as shown in FIG. 3.

Shank bit 10 rotates in bearing receptacle 31 during operational use, and bit head 12 abrades with its support surface 12.5 against abutting surface 26 of insert 20. Because insert 20 is made of a hard material and bit head 12 is produced from a material that is softer relative thereto, only a small amount of wear occurs on bit holder 40. Shank bit 10, in contrast, is relatively more severely worn away in the region of its support surface 12.5. What results is a wear system in which the expensive bit holder 40 is worn away less than shank bit 10. A plurality of shank bits 10 can thus be used on one bit holder 40 before the latter reaches its wear limit.

Two wear effects occur, as indicated above, when shank bit 10 abrades away in the region of its support surface 12.5. On the one hand, the overall height of support segment 12.1 becomes reduced. On the other hand, abutting surface 26 of insert 20 is also worn away. As a result of these effects, bit shank 11 continuously recedes in the direction of its longitudinal center axis M into insert 20. First cylindrical segment 11.1 correspondingly slides along first diameter region 21, and securing element 30 along second diameter region 23. Free rotatability of shank bit 10 around its longitudinal center axis M is guaranteed by the use of a resetting space NR. This resetting space NR is shown in FIG. 3. It is created by the fact that the axial length of first cylindrical segment 11.1 is less than the axial longitudinal extent of first diameter region 21. In order to allow bit holder 40 having insert 20 to be utilized in wear-optimized fashion over its maximum possible service life, the axial extent of resetting space NR should be selected in the range between 4 mm and 20 mm.

With the geometrical relationships indicated, it is thus possible to go to the lower limit range of 4 mm when the substrate to be worked is fairly soft. Greater lengths for resetting space NR are better suited for hard ground. In road construction, where mixed concrete and asphalt need to be worked, a length of the resetting space from 7 mm to 20 mm has proven suitable.

In order to ensure secure retention of shank bit 10 over the entire service life of bit holder 40 in the context of the above-described wear system, second diameter region 23 of insert 20 is also dimensioned, in terms of its axial extent, so that securing element 30 can slide in an axial direction against the inner wall of second diameter region 23 in order to compensate for the longitudinal wear of insert 20 and of bit head 12. The axial length of the second diameter region must therefore be correspondingly adapted to the dimensions of resetting space NR. Applied to the dimensioning specifications above, second diameter region 23 must therefore have an axial length of at least 4 mm to 20 mm, plus twice a retention length for the securing element (position of securing element 30 in the unworn and worn state of bit holder 40). The retention length should be a minimum of 2 mm.

As is evident from FIG. 3, in the interest of a compact configuration the terminal shoulder 11.5 can be reset into the region of an opening segment that forms drive-out opening 43. The axial length of the opening segment is to be dimensioned accordingly.

During operational use, bit shank 11 slides with its first cylindrical segment 11.1 against the associated inner surface of first diameter region 21. Because, here as well, insert 20 is made of a hard material and bit shank 11 is made of a softer material, only a small amount of wear is caused here on insert 20 and thus on bit holder 40.

Securing element 30 as shown in FIGS. 7 to 10 is braced with its abutting regions 38.6 and 38.7, in linear or annular fashion with little radial extent, with respect to the groove walls of securing receptacle 11.4, so that good rotation behavior is achieved.

Once shank bit 10 is worn out, it can be removed. For this, a drive-out force is introduced by means of a suitable drive-out tool into the free end of bit shank 11 in the region of shoulder 11.5. Shank bit 10 with its securing element 30 then slides over second diameter region 23 until it springs back radially in the region of first diameter region 21. Shank bit 10 can then be freely removed.

Figure 12:
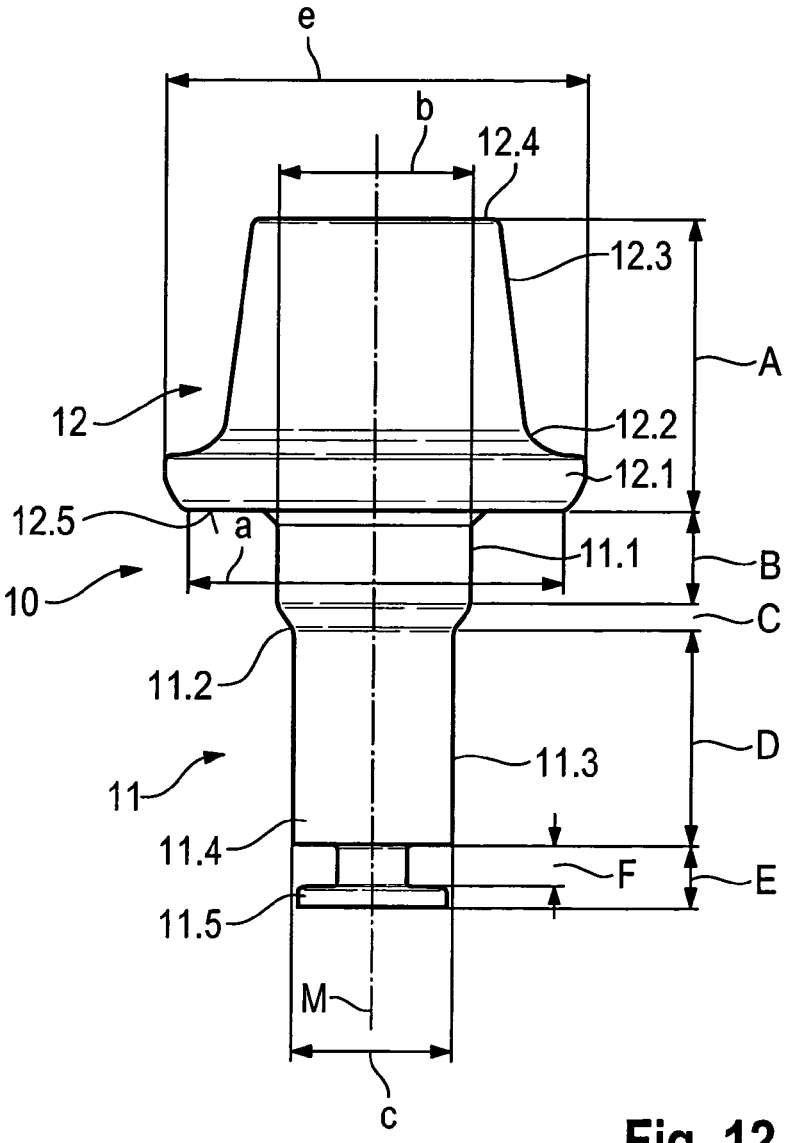
FIG. 12 is a side view of an alternative variant embodiment of a shank bit.
Figure 13:
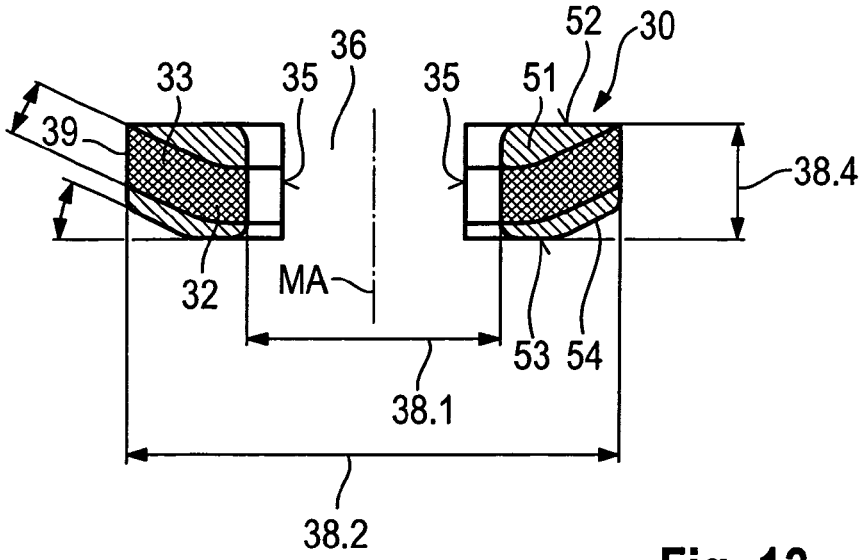
FIG. 13 shows a securing element for the shank bit according to FIG. 12, in a side view and in section along the section plane marked XIII-XIII in FIG. 14.
Figure 14:
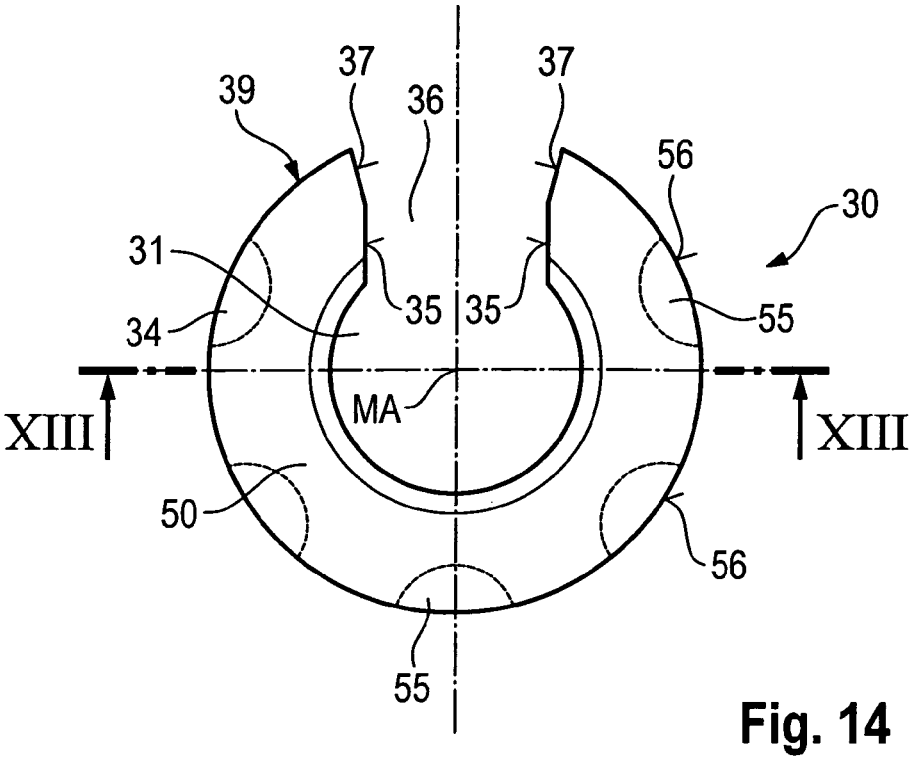
FIG. 14 is a plan view of the securing element according to FIG. 13.

FIGS. 12 to 14 show an alternative variant configuration of the invention. The configuration of shank bit 10 corresponds in terms of its general conformation to shank bit 10 according to FIG. 1. Shank bit 10 according to FIG. 12 can be installed, using securing ring 30 according to FIGS. 13 and 14, in insert 20 of bit holder 40 according to FIGS. 2, 3, and 11. In order to avoid repetition, those configuration features which differ will be discussed below; otherwise reference is made to the statements above.

Shank bit 10 having bit shank 11 and bit head 12 is once again produced as an extruded part or alternatively as a lathe-turned part.

Bit head 12 possesses support segment 12.1 having support surface 12.5. Support segment 12.1 leads via a convex radius transition into support surface 12.5. Support segment 12.1 possesses an outside diameter e in the range between 40 mm and 45 mm. Diameter a of support surface 12.5 is selected in the range between 36 mm and 42 mm. With these diameter relationships, i.e. more generally with a diameter ratio from ≥1 to 1.3 (diameter e/diameter a), considerable deformation is achieved in the region of support segment 12.1 upon cold extrusion. These material deformations result in a particularly tough composite material with good strength properties.

Bit head 12 once again comprises, adjacent to support segment 12.1, a concave taper 12.2 that leads into the frustoconical discharge surface 12.3. A cutting element receptacle 12.4 is formed at the end. A cutting element (13, see above) can be soldered into this.

Support surface 12.5 leads via a frustoconical transition segment into first cylindrical segment 11.1. The extent of first cylindrical segment 11.1 in the direction of longitudinal center axis M is selected to be appreciably shorter than in the exemplifying embodiment according to FIG. 1. Length B is 9 mm in the present case. This represents, with a diameter b of 19.8 mm, a sufficient dimension for road milling applications. With the shortened length of first cylindrical segment 11.1, the axial length of resetting space NR becomes greater. In the present case what results for road milling applications with mixed surfaces (asphalt and concrete) is a particularly suitable wear length of approx. 15 mm to 18 mm for resetting space NR.

Second cylindrical segment 11.3 has an extent D in the direction of longitudinal center axis M of 21.6 mm, and thus holds securing receptacle 11.4 at a spacing from support surface 12.5 sufficient for road milling applications. Diameter c of second cylindrical segment 11.3 is 16.5 mm.

Securing receptacle 11.4 is embodied with a width F of 4.5 mm, consequently somewhat wider than in FIG. 1 and coordinated with securing element 30 according to FIGS. 13 and 14.

The end-located shoulder 11.5 has a thickness of 3 mm and is thus sufficiently stable for road milling applications.

The conformation of securing element 30 will be discussed in further detail below with reference to FIGS. 13 and 14.

Securing element 30 comprises the stamped and bent part shown in FIGS. 7 to 10 as a basic member, with the difference that recesses 34 are not cut in as far as clamping part 32. Reference is made to the statements above regarding the features that are otherwise identical.

This base member is equipped on its surface with a layer 50 that has a lower hardness than the base member. In the present case layer 50 is made of a plastic material. In a particularly preferred application, layer 50 is made of a plastic material, from polyurethane or a composite material containing polyurethane. For reasons of production simplification and in order to create an intimate bond with the base member, layer 50 is molded onto the base member using the injection molding process.

Layer 50 comprises two coating regions 51 and 54. Coating regions 51, 54 are arranged respectively on the concavely curved upper and the convex undersides of the base member. In the region of recesses 34, coating regions 51, 54 are interconnected via connecting segment 55 in such a way that recesses 34 are completely filled up. The radially externally located curved regions of layer 50 thus transition flush into the convex curved regions of holding segments 39. Layer 50 can also project radially beyond holding segments 39.

Radially outer contact segments 56 are formed with the layer regions that fill up recesses 34. These segments abut internally against second diameter region 23 of insert 20. This produces here a friction surface pairing that introduces, in the direction of the longitudinal center axis, an additional frictional resistance that counteracts a pulling-out motion in that direction. The retention of shank bit 10 in insert 20 is thereby improved.

As is evident from FIG. 13, the radially externally located regions of holding segments 39 remain exposed, so that their function as described above is maintained. In addition, introduction chamfers 37 and rims 35 remain uncoated, so that the guidance function upon installation in cutting element receptacle 12.4 is maintained. Inside diameter 38.1 is furthermore also exposed and forms, with the groove base of securing receptacle 11.4, a wear-resistant and permanently accurately fitted rotary bearing system.

The two coating regions 51 and 54 respectively constitute bearing surfaces 52, 53 that proceed in the form of a partial ring around the longitudinal center axis of securing element 30. The two bearing surfaces 52, 53 extend radially and are parallel to one another. They serve for abutment against the groove walls of securing receptacle 11.4, in which context the axial clearance described above must be complied with. In order to achieve tilt-free operation, the axial clearance should be selected in the range between ≥0.2 mm and ≤4 mm. The two bearing surfaces 52, 53 complete the accurately fitted rotary bearing system. Layer 50 increases the stiffness, in particular the torsional strength of the base member, so that this stiff composite member reliably retains shank bit 10.

The invention claimed is:

1. A shank bit for a road milling machine or the like, comprising:

a bit head including a support segment having an annular support surface, the support surface having an outside diameter in a range of from 30 mm to 60 mm; and a bit shank having a longitudinal center axis and including:

a first cylindrical segment indirectly or directly adjacent to the bit head, the first cylindrical segment having a diameter in a range of from 18 mm to 30 mm, and the first cylindrical segment having a length in the direction of the longitudinal center axis in a range of from 4 mm to 15 mm, wherein a ratio of the outside diameter of the support surface to the diameter of the first cylindrical segment is in a range of from 1.6 to 3.3; and a second cylindrical segment indirectly or directly adjacent to the first cylindrical segment on an opposite end of the first cylindrical segment from the bit head, the second cylindrical segment having a diameter in a range of from 14 mm to 25 mm, wherein a diameter ratio of the diameter of the first cylindrical segment to the diameter of the second cylindrical segment is in a range of from 1.1 to 2.5.

2. The shank bit of claim 1, wherein the second cylindrical segment has a length in the direction of the longitudinal center axis in a range of from 10 mm to 40 mm.

3. The shank bit of claim 2, wherein the length of the second cylindrical segment is in the range of from 16.5 mm to 26.5 mm.

4. The shank bit of claim 1 wherein the bit shank has a shank length in the direction of the longitudinal center axis in a range of from 35 mm to 45 mm.

5. The shank bit of claim 1, wherein:

a ratio of the outside diameter of the support surface to the diameter of the second cylindrical segment is in a range of from 2.0 to 4.2.

6. The shank bit of claim 1, wherein:

the bit shank includes a distal end portion located away from the bit head, and a securing receptacle defined in the distal end portion; and further comprising a securing element received in the securing receptacle.

7. The shank bit of claim 6, wherein:

the securing element has a relaxed outside diameter in a relaxed state; and the relaxed outside diameter of the securing element exceeds the diameter of the second cylindrical segment by at least 0.05 mm.

8. A shank bit for a road milling machine or the like, comprising:

a bit head;

a bit shank having a longitudinal center axis and including:

a first cylindrical segment indirectly or directly adjacent to the bit head, the first cylindrical segment having a diameter in a range of from 18 mm to 30 mm, and the first cylindrical segment having a length in the direction of the longitudinal center axis less than or equal to 30 mm;

a second cylindrical segment indirectly or directly adjacent to the first cylindrical segment on an opposite end of the first cylindrical segment from the bit head, the second cylindrical segment having a diameter differing from the diameter of the first cylindrical segment; and a distal end portion located away from the bit head, and a securing receptacle defined in the distal end portion; and a securing element received in the securing receptacle, the securing element including a partially cylindrical bearing receptacle and an introduction opening providing radial access to the bearing receptacle.

9. The shank bit of claim 8, wherein:

the introduction opening is demarcated by two rims facing each other, the rims transitioning into angled introduction chamfers.

10. The shank bit of claim 8, wherein:

the securing element includes a clamping part including at least one radially outer recess.

11. The shank bit of claim 10, wherein:

the at least one radially outer recess has a partly circular shape.

12. The shank bit of claim 10, wherein:

the clamping part includes a fastening segment; and the at least one radially outer recess extends radially deeper into the clamping part than the fastening segment extends radially from the clamping part.

13. The shank bit of claim 8, wherein:

the securing element includes a clamping part including a fastening segment; and a cross-section of the clamping part in the direction of the longitudinal center axis is decreased by the fastening segment.

14. The shank bit of claim 8, wherein:

the securing element includes a clamping part including a fastening segment; and the clamping part is bent in a radially outer region of the clamping part.

15. The shank bit of claim 8, wherein:

the securing element includes an outer periphery including convex curved segments.

16. The shank bit of claim 8, wherein:

the bit head includes a support surface facing toward the bit shank; and the securing receptacle of the bit shank is spaced from the support surface of the bit head by a spacing in a range of from 15 mm to 50 mm.

17. The shank bit of claim 8, wherein:

the securing element includes two mutually parallel demarcating surfaces spaced from one another in the direction of the longitudinal center axis.

18. The shank bit of claim 8, wherein:

the securing element has an axial clearance in the securing receptacle of no greater than 2 mm.

19. The shank bit of claim 18, wherein:

the axial clearance is no greater than 1 mm.

20. The shank bit of claim 8, wherein:

the securing element has, in the securing receptacle, a radial clearance in a range of from 3 mm to 9 mm.

* * * * *